United States Patent [19]

Fanson

[11] 3,949,531

[45] Apr. 13, 1976

[54] HOLLOW CORED CONCRETE SLAB AND METHOD OF MAKING THE SAME

[76] Inventor: James L. Fanson, W230 S2421 Morningside Drive, Waukesha, Wis. 53186

[22] Filed: Apr. 18, 1974

[21] Appl. No.: 461,996

[52] U.S. Cl. ..... 52/380; 52/577; 52/600; 264/256; 264/261; 264/274; 264/277

[51] Int. Cl.[2] ..... E04B 1/16; B28B 1/16

[58] Field of Search ..... 52/577, 576, 600, 606, 52/380, 382, 699, 319, 325; 264/261, 256; 249/176, 177; 425/110, 123

[56] References Cited

UNITED STATES PATENTS

| | | | |
|---|---|---|---|
| 1,160,384 | 11/1915 | Crane | 52/577 |
| 1,642,980 | 9/1927 | Turner | 249/177 |
| 1,875,131 | 8/1932 | Pentland | 52/577 |
| 2,126,301 | 8/1938 | Wolcott | 52/577 |
| 2,159,991 | 5/1939 | Hilpert | 52/577 |
| 2,916,909 | 12/1959 | Miller | 52/577 |
| 3,488,909 | 1/1970 | Bahr | 52/382 |

FOREIGN PATENTS OR APPLICATIONS

| | | | |
|---|---|---|---|
| 210,958 | 10/1957 | Australia | 249/177 |

*Primary Examiner*—Ernest R. Purser
*Assistant Examiner*—James L. Ridgill, Jr.
*Attorney, Agent, or Firm*—Andrus, Sceales, Starke & Sawall

[57] ABSTRACT

A hollow cored concrete slab is the product of the method which includes casting a base layer of concrete into a suitable form. Placing precast concrete channel members in transversely spaced relation on the freshly cast base layer with the flanges of the members in contact with the base layer and the webs of the members in spaced relation from the base layer. Casting an upper layer of concrete onto the fresh base layer and around the channel members and striking the upper layer in spaced relation above the channel members so that the upper layer of concrete covers the webs of the channel members to a given depth. The slab is then cured with the channel members remaining a structural part thereof and providing for the transversely spaced hollow cores therein.

4 Claims, 13 Drawing Figures

Fig. 11
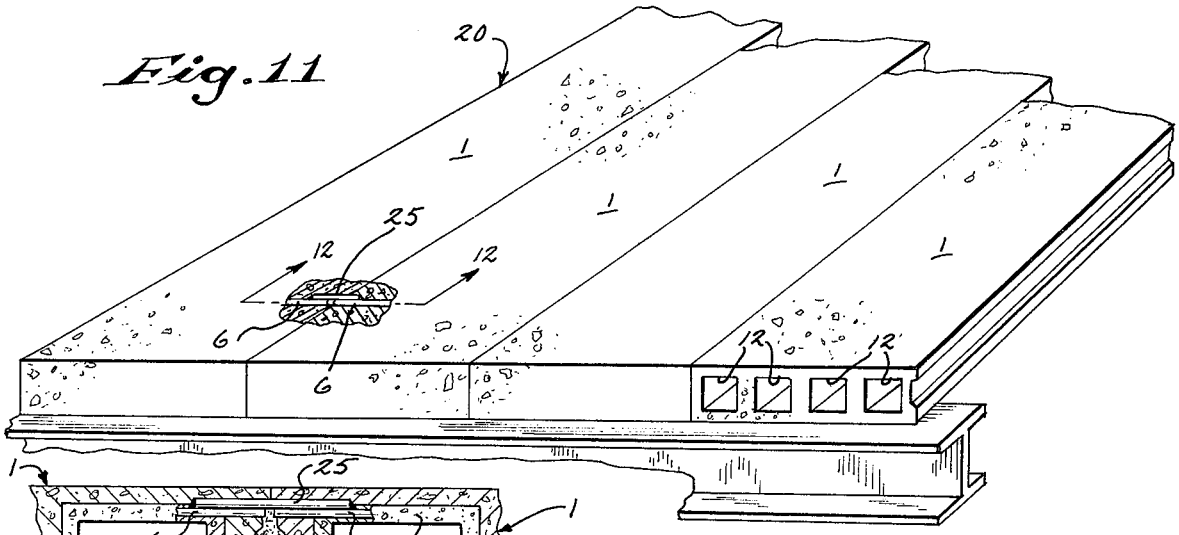
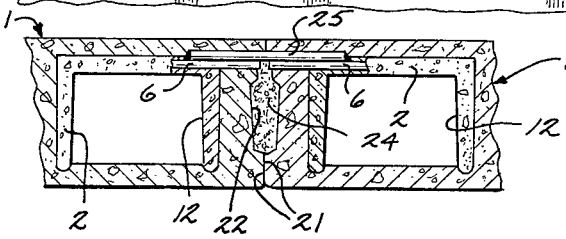
Fig. 12
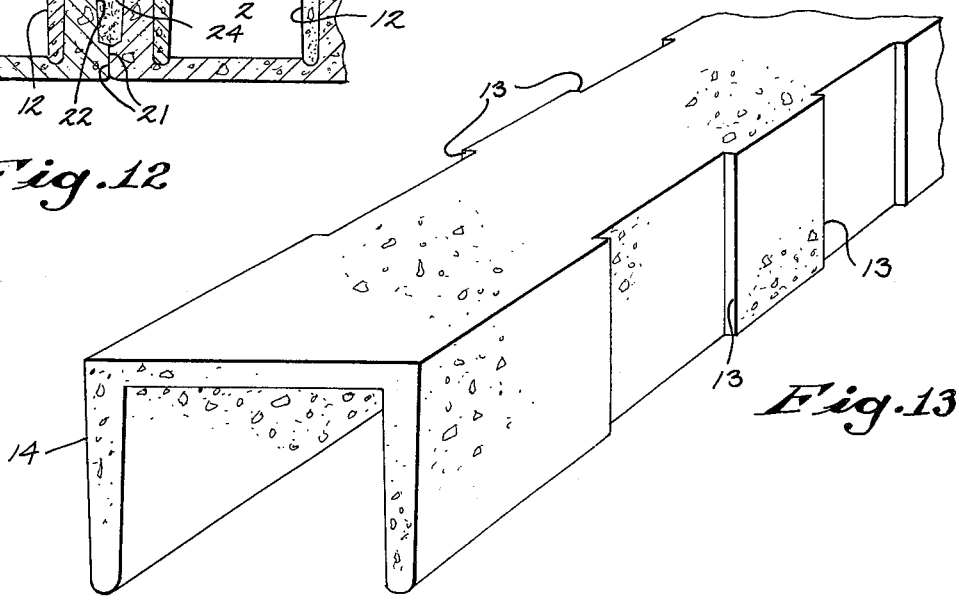
Fig. 13
Fig. 10
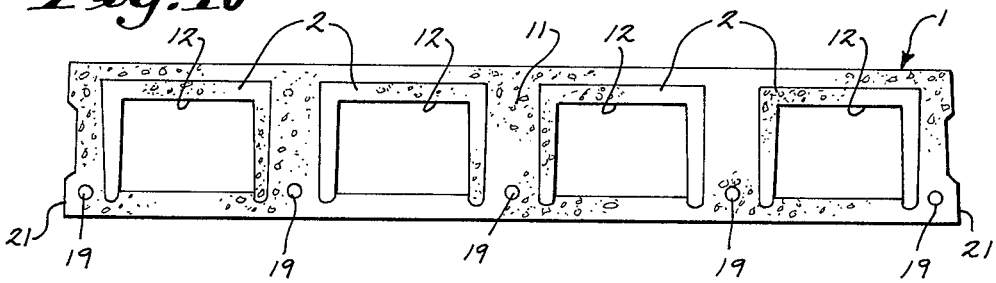

HOLLOW CORED CONCRETE SLAB AND METHOD OF MAKING THE SAME

BACKGROUND OF THE INVENTION

This invention relates to a hollow cored concrete slab and the method of making the same.

Hollow cored concrete slabs are extensively used in the construction of buildings to provide floors, ceilings, walls and roofs. Such slabs also find use in the building of bridges, wharves, piers and other structures. The slabs so used may be prestressed and/or reinforced with a variety of tendons such as strands and bars generally of steel.

Generally the fabrication of hollow cored concrete slabs involves the use of hugh casting machines requiring the outlay of substantial capital investment. It is generally an object of this invention to provide a method of fabricating composite hollow cored concrete slabs which eliminates the need for the hugh casting machines and the capital outlay they represent, and which produces a product that is structurally and economically competitive with the product of those machines.

SUMMARY OF THE INVENTION

Broadly, the composite hollow cored slab of this invention is the product of the method which includes casting a base layer of concrete into a suitable form. Placing precast concrete channel members in transversely spaced relation on the freshly cast base layer with the flanges of the members in contact with the base layer and the web of the members in spaced relation from the base layer. An upper layer of concrete is then cast onto the fresh base layer and around the precast channel members. The upper layer of concrete is struck in spaced relation above the channel members so that the upper layer of concrete covers the web of the members to a given depth. The concrete is then cured to complete the slab of which the channel members remain a structural part and provide for the transversely spaced hollow cores therein.

DESCRIPTION OF THE DRAWING FIGURES

The drawings furnished herewith illustrate the best mode presently contemplated for carrying out the invention and are described hereinafter.

Figure 8:
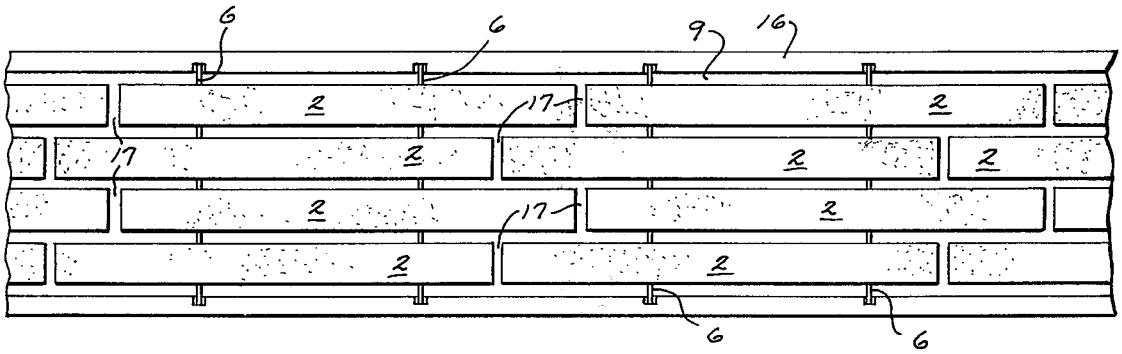
Figure 9:
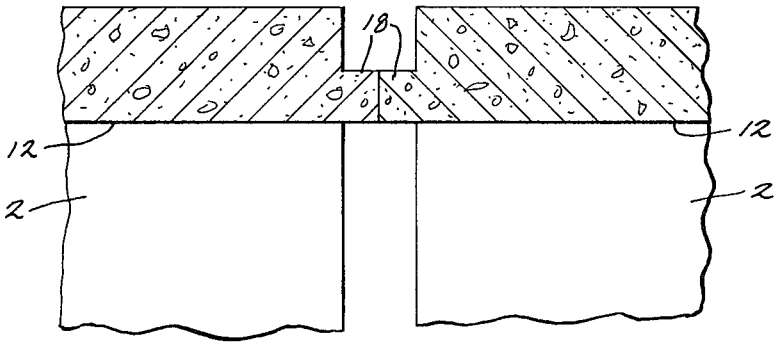
Figure 7:
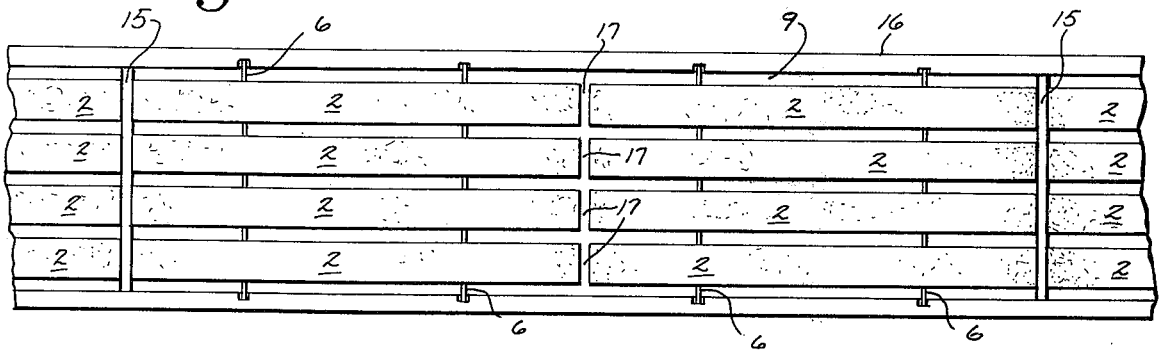

FIG. 7 is a partial plan view showing a form or mold for fabricating a relatively long span comprising a plurality of slabs and further illustrates the stage in the method of this invention wherein the channel members are placed in contact with the base layer of fresh concrete and wherein the length of a slab requires a plurality of channel members to be placed end for end in longitudinally aligned relation with a gap therebetween and with the several gaps being transversely aligned;

FIG. 8 is a view generally similar to that of FIG. 7 and showing the longitudinally aligned channel members staggered longitudinally in relation to the next adjacent longitudinally aligned channel members to place the gaps between the aligned channel members in longitudinally staggered relation;

FIG. 9 is an enlarged detail sectional view in the region of the gap between longitudinally aligned channel members and shows the members being provided with opposed longitudinal projections placed in abutting relation to prevent fresh concrete from falling through the gap to possibly obstruct the core passage at the gap;

FIG. 10 is an end elevation of a completed slab and shows longitudinally extending prestressing and/or reinforcement tendons embodied in the slab;

FIG. 11 is a perspective view showing a plurality of slabs fabricated according to the method of this invention arranged and connected in side-by-side arrangement to form a floor or deck;

FIG. 12 is an enlarged sectional detail view taken generally on line 12—12 of FIG. 11; and FIG. 13 is an enlarged perspective view of a channel member as may be used in the method of this invention and having longitudinally spaced mechanical anchorage or interlock grooves in the flanges thereof.

DESCRIPTION OF THE ILLUSTRATED EMBODIMENTS

Figure 1:
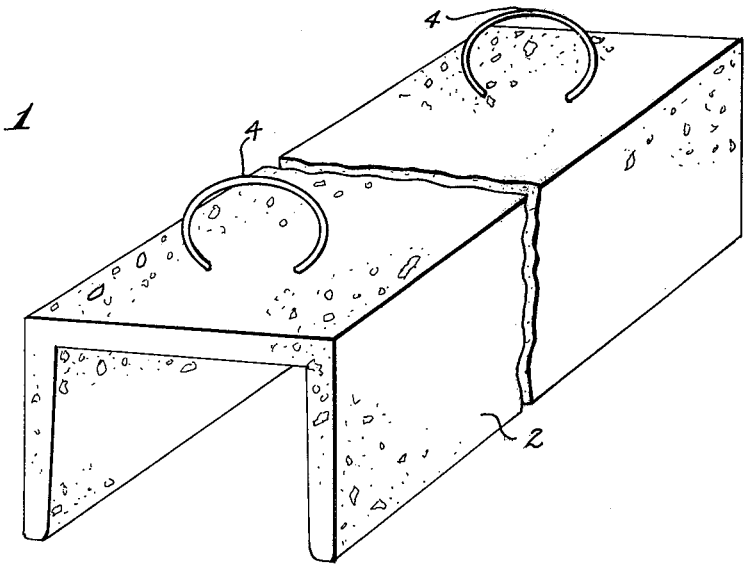
FIG. 1 is a perspective view of a precast concrete channel member as used in the hollow cored slab and method for making the same according to this invention.

The method according to this invention provides for the fabrication of a composite hollow cored concrete slab 1 which may be generally characterized as having a relatively high moment of inertia, offering acceptably high resistance to loads and forces acting in shear, providing for relatively low weight per unit area, and which lends itself readily to mild steel reinforcement and/or prestressing tendons. Generally the method contemplates use in the slab 1 of relatively thin precast concrete channel section members 2 as generally shown in FIG. 1.

Figure 2:
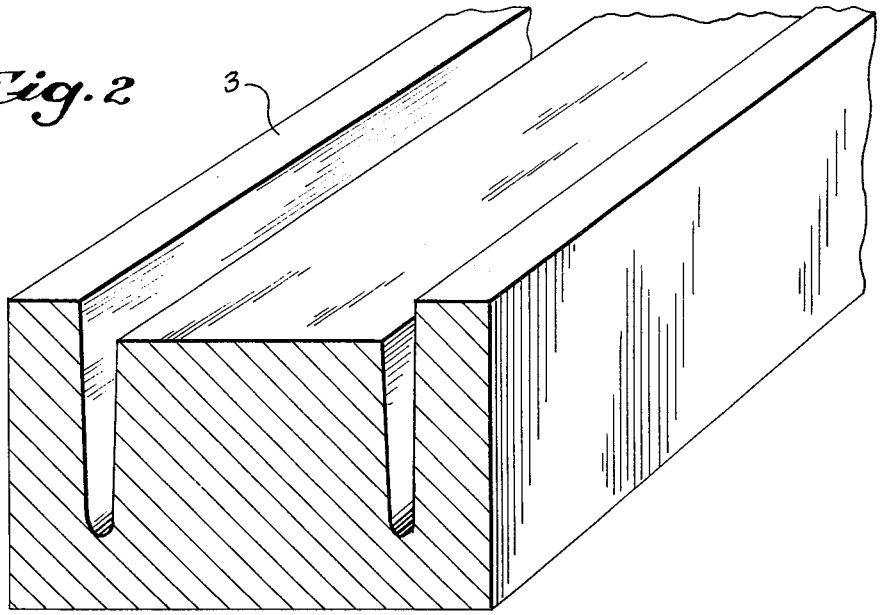
FIG. 2 is a partial perspective view of the mold or form for casting the concrete channel member of FIG. 1.

It is contemplated that the channel members 2 will be precast in suitable forms or molds 3 as shown in FIG. 2. Generally the channel members 2 will be fabricated with the same concrete mix used in making the slab 1, but the mix may be different if desired. At the time of casting the channel members 2, suitable wire bails 4 may be partially embedded in the members to provide a convenient means for subsequent handling. The channel members 2 are cast sufficiently far in advance of their incorporation in a slab 1 to provide for a sufficient partial cure to permit handling with minimum damage to the members. It is contemplated that the partial cure time for the members 2 prior to their use in a slab 1 shall generally not exceed twenty-four hours.

Figure 3:
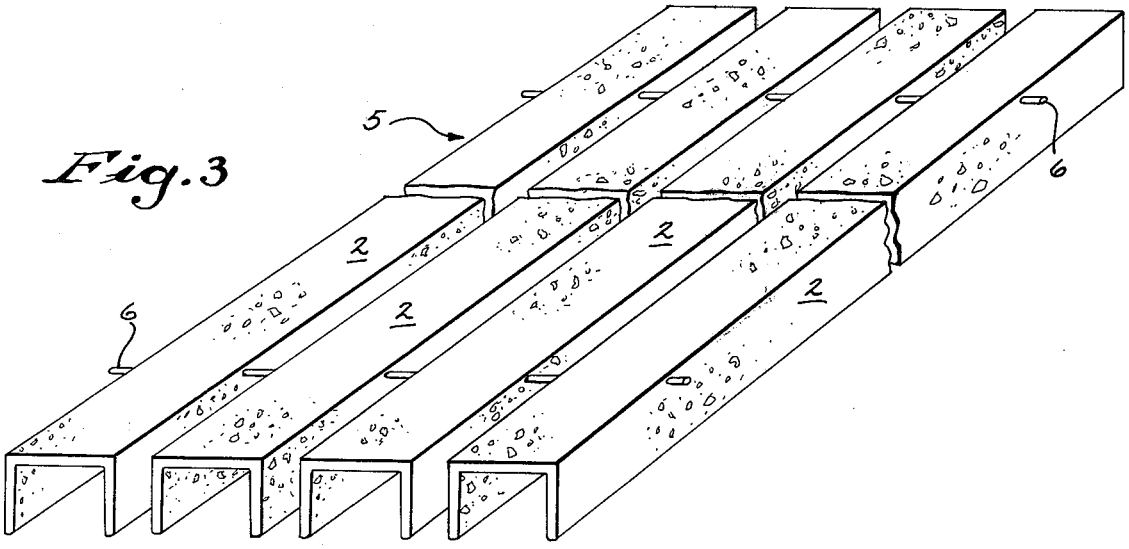
FIG. 3 is a reduced perspective view of a plurality of precast concrete channel members connected by a pair of longitudinally spaced, transversely extending metal rods or bars to form a unitary assembly for use in the hollow cored slabs of this invention.

Concrete slabs are generally fabricated in widths requiring two or more channel members 2 to be used in transversely spaced, side-by-side relation. FIG. 3 shows an assembly 5 of four spaced side-by-side channel members 2. The assembly 5 may be precast in a suitable form, not show, as an integral unit wherein a pair of transversely extending longitudinally spaced rods or bars 6 are embedded in the webs of the channel members 2 making up the assembly. For reasons to be noted hereinafter, the rods or bars 6 preferably project outwardly beyond the opposed outermost channel members 2 of the assembly 5. The rods or bars 6 are preferably made of metal and maintain the desired relative positions of the channel members 2 and provide a convenient means for handling the assembly 5 after the channel members are sufficiently cured to permit handling with minimum damage. The rods or bars 6 further provide transverse reinforcement in the finished slabs 1 to better resist lateral stresses.

The slab 1 is fabricated in a suitable rectangular form 7 assembled on a casting table 8. The inside surface of the form 7 as well as that portion of the table 8 enclosed by the form may be coated with a suitable parting compound.

Figure 4:
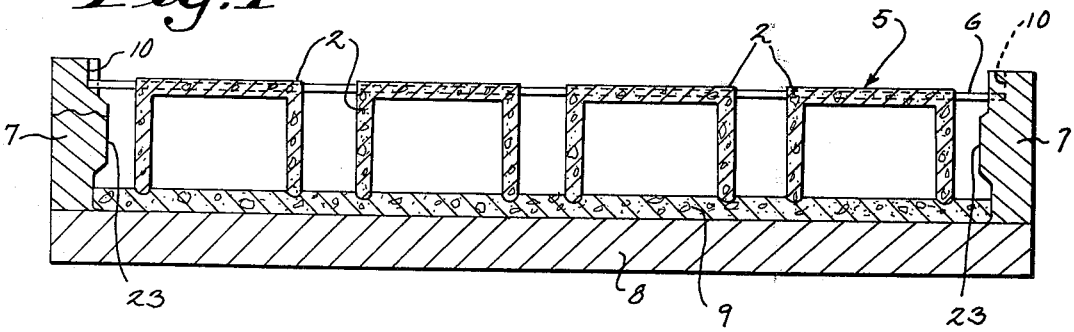
FIG. 4 is a sectional view with parts broken away showing the form or mold for making the hollow cored slab and further illustrates a stage in the method of this invention wherein the connected channel members of FIG. 3 are placed in contact with the base layer of fresh concrete.
Figure 6:
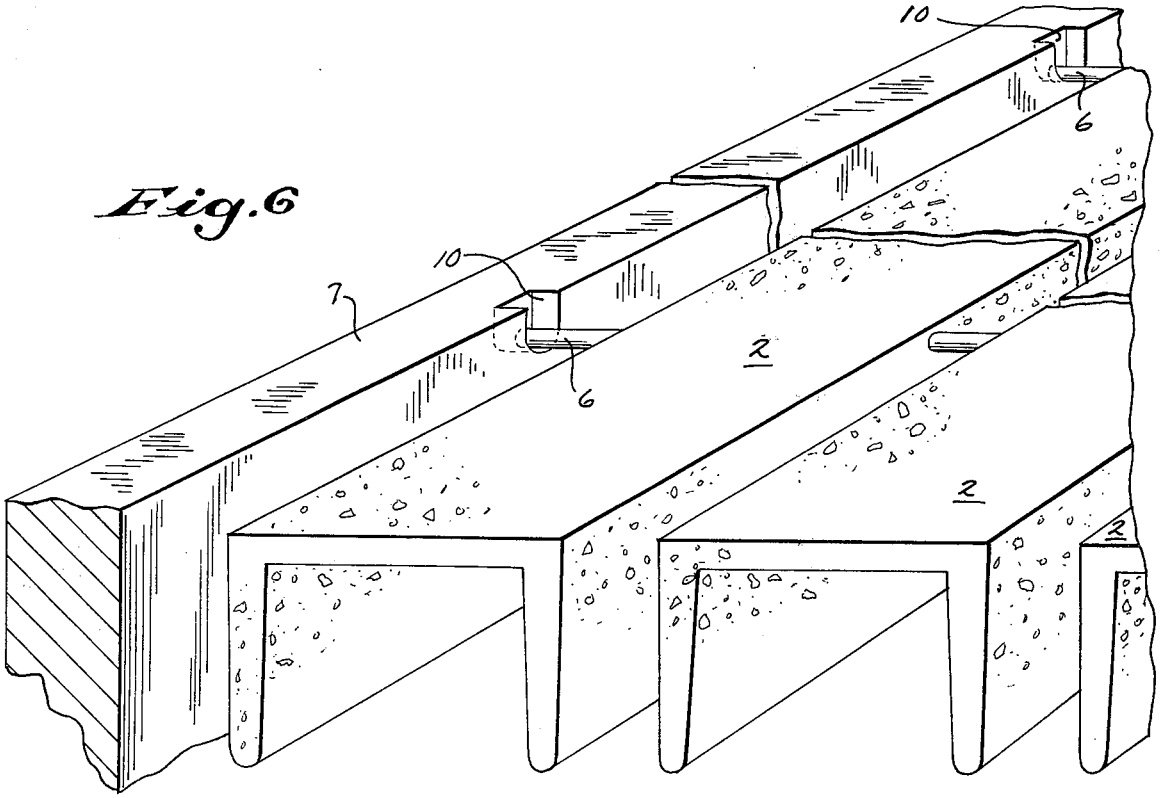
FIG. 6 is an enlarged partial perspective view showing the means for supporting the unitary assembly of channel members in a mold or form.

After the form 7 and table 8 are coated with the parting compound, a relatively thin bottom or base layer 9 of concrete mix is poured into the form and substantially leveled. Next the channel members 2 with flanges extending downwardly are arranged on the bottom layer 9 in the form 7, either individually in transversely spaced side-by-side relation or in an assembly 5 as generally shown in FIG. 4. Means such as clamping members, not shown, may be used to preclude the individual channel members 2 from sinking too far into the fresh concrete bottom layer 9. Where the channel members 2 are part of an assembly 5, the opposed projections of the bars or rods 6 beyond the outermost channel members are adapted to seat in recesses 10 provided in the form 7 as shown in FIGS. 4 and 6 to regulate the depth of penetration of the channel flanges into the bottom layer 9. The bottom edges of the channel flanges must at least make contact over their full length with the bottom layer 9 and preferably will penetrate the layer sufficiently to be keyed into the layer. Means, not shown, for vibrating the fresh concrete may be relied upon to attain the depth of penetration desired.

Figure 5:
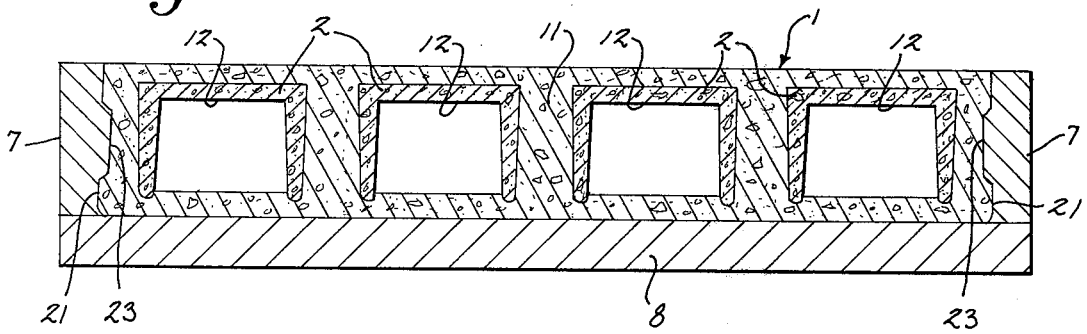
FIG. 5 is a view generally similar of FIG. 4 and illustrates a more advanced stage in the method of this invention wherein the form or mold cavity has been filled.

After the channel members 2 or an assembly 5 thereof are properly arranged and seated on the fresh concrete bottom layer 9, a further concrete layer 11 is poured to fill the form 7, care being taken to fill the transverse space between the channel members 2 so that upon curing a good bond is achieved with the bottom layer. The contact between the flanges of the channel members 2 and the bottom layer 9 should preclude the flow of concrete mix under the flange edges during casting of the upper layer 11. The concrete channels 2 will not float in the concrete surrounding it, but instead will become a structural part of the slab 1 and will act structurally with the surrounding poured concrete in resisting stresses. FIG. 5 shows the newly cast slab 1 after the upper concrete layer 11 is struck generally level with the top edge of the form 7 and providing that the upper surface of the webs of the channel members 2 are covered to a given depth. After an appropriate cure time, the form 7 can be removed from the slab 1 and the latter moved to storage or site of installation as the circumstances require.

From FIG. 5, it will be clearly seen that as incorporated in the slab 1, the channel members 2 serve as nonremovable core members providing for generally rectangular, transversely spaced, longitudinally extending hollow cores or passages 12 to substantially lessen the weight of the slab. The hollow cores or passages 12 may be utilized for electrical chases, heating ducts, pepes, cables and other trades gear when the slabs 1 are assembled in a building.

When the channel members 2 are precast and thereafter incorporated within a slab 1 within a 24 hour period, it is believed that the members remain but partially cured and, particularly if wetted prior to incorporation into the slab, a bond is achieved to the several layers 9 and 11 of concrete cast around the members. However, it is not essential that bonding is achieved between the channel members 2 and the adjacent poured concrete in the slab 1 since the members will contribute their desired structural characteristics even in an unbonded condition. Even if bonding is not achieved between the members 2 and the adjacent poured concrete in the slabs 1, slippage therebetween is unlikely in view of the relatively large surface area between the members and the poured concrete which effectively provides for a frictional keying therebetween. If desired, however, the outwardly facing surfaces of the channel members 2 may be provided with mechanical anchorage means such as the plurality of longitudinally spaced, vertically extending notches or recesses 13, as generally shown on the channel member 14 in FIG. 13, to additionally mechanically interlock the members to the poured concrete in the slab 1.

It is contemplated that the method of this invention likely will require apparatus for lifting and moving the channel members 2 or an assembly 5 thereof, as well as the finished slabs 1. Apparatus for pouring concrete will also likely be necessary on the site for fabrication of the channel members 2 and/or the assemblies 5 thereof, and the slabs 1. The invention does, however, eliminate the need for monstrous and expensive machines as are now commonly employed for casting concrete slabs.

A slab 1 fabricated according to the method of this invention may have any desired length and FIG. 7 shows how a slab is formed as a part of a much longer span. In the fabrication of the longer spans, the desired slab length may be defined by transversely extending blocks or dams 15 inserted in the form 16. Alternatively, the longer spans can be continuous and the slabs 1 are then formed by a cutting or sawing operation at the desired length.

Whenever possible it is intended that the individual channel members 2 or the assemblies 5 thereof will generally correspond in length to the slab 1 fabricated therewith. This may not always be possible or desirable, however, in which case the channel members 2 will be generally aligned longitudinally as shown in FIGS. 7 and 8 with a relatively small gap 17 therebetween. When the upper layer 11 is poured, the concrete mix will flow into the gap 17. If desired, the transverse alignment of the gaps 17, as shown in FIG. 7 can be avoided by placement of the transversely spaced channel members 2 in a manner to stagger the gaps 17 longitudinally as generally shown in FIG. 8.

If the aligned hollow cores or passages 12 of longitudinally aligned channel members 2 having a gap 17 therebetween are not needed for trades gear, it is probably of little consequence if the concrete mix poured for the upper layer 11 falls between the members and interrupts or blocks the passages at the gap. If only a relatively small or insignificant amount of concrete mix falls through the gap 17 and into the region of the aligned passages 12, the resultant longer passage will remain available for trades gear. In order to minimize the fall through of concrete mix at gaps 17 when pouring the upper layer 11, the adjacent ends of the channel members 2 can be provided with relatively thin longitudinal projections 18 which extend horizontally immediately above and generally over the width of the passage or hollow core 12. The opposing projections 18 of aligned channel members 2 are brought into abutting or near abutting relation as generally shown in FIG. 9 to generally preclude fall through of concrete mix at gaps 17 when casting the upper layer 11 and substantially assure that passages 12 will continue through the gap and provide that the resultant longer passage will be available for trades gear.

The method of this invention also contemplates the inclusion of longitudinally extending metal reinforcement tendons 19 within the slabs 1 when and if desired. The reinforcement tendons 19 are disposed in the poured concrete between adjacent channel members 2 and outwardly of the outermost channel members as generally shown in FIG. 10. The tendons 19 may take the form of mild steel reinforcement bars or rods and/or prestressing strands or bars.

When a plurality of slabs 1 are assembled to form a floor or deck 20 as generally shown in FIG. 11, the slabs of any desired length are placed in side-by-side relation. As shown, the ends of the hollow cores or passages 12 in the slabs 1 can be closed with mortar if not required for trades gear. FIG. 12 shows a form of joinder that may be utilized between adjacent slabs 1 wherein the longitudinally extending heel projections 21 provided adjacent to the bottom on the opposed sides of the slab are brought into abutting relation. Immediately above the abutting heel projections 21, the adjacent slabs 1 form a grout key cavity 22 which results by virtue of the longitudinally extending inward projection 23 provided inwardly and centrally on the opposed sides of form 7 as shown in FIGS. 4 and 5. The adjacent slabs 1 of the floor or deck 20 are grouted together by filling the cavity 22 with a suitable grout 24.

With further reference to FIG. 12, either at the time of casting the slabs 1 of subsequently, the end portions of the aligned rods or bars 6 of the adjacent slabs 1 have their upper surface laid bare or exposed. A splice bar 25 bridges the gap between the aligned rods or bars 6 and is welded to the respective end portions of the rods or bars to provide for continuous lateral reinforcement across the floor or deck 20 to better resist any laterla stresses imposed on the structure. The grout 24 or lateral suitable patching compound is used to fill the depressions in the floor or deck 20 at the locations of the splice bars 25.

The composite hollow cored slabs 1 can, of course, be fabricated in various depths or thicknesses, ranging perhaps from four inches to twelve inches or more depending on shear and other load conditions to be contemplated. Slabs 1 can be fabricated in various widths but 4 feet is generally preferred with handling ease being a major consideration. Assuming an application for slabs 1 wherein shear and other load conditions require a slab of 8 inch depth, the base layer 9 will be on the order of 1-¼ inches deep. For an 8 inch slab 1, it is contemplated that the channel member 2 will be 8-⅞ inches wide along the web and 6-¼ inches deep along the flanges as measured on the outside. The web of the channel member 2 is ¾ inch thick, and each flange is 1 inch thick at the web and provided with a draft taper toward the free end where the thickness is about ¾ inch. In the 8 inch slab 1 which is 4 feet wide, four channel members 2 are arranged on the base layer 9 with a space of 2-¾ inches transversely between the channel members. The channel members 2 in the 8 inch slab 1 contact the base layer 9 with a penetration depth of about ½ inch. Thus, when the upper layer 11 is poured and struck for the 8 inch slab 1, the web of the channel member 2 will be covered to a depth of about 1 inch. With a flange penetration of about ½ inch into the base layer 9, the generally rectangular hollow cores 12 in the 8 inch slab 1 will measure roughly 5 inches by 7 inches.

In those applications where shear loading is not a design control factor as, for example, when the slabs 1 are used to build a wall, the thickness of the web of channel 2 together with the depth of cover above the web provided by the upper concrete layer 11 may generally approximate the thickness of the base concrete layer 9. Where shear loading is a minimal factor, such proportioning is perhaps best because it places the hollow cores or passages 12 generally midway between the major outer surfaces of the slab 1.

Various modes of carrying out the invention are contemplated as being within the scope of the following claims particularly pointing out and distinctly claiming the subject matter which is regarded as the invention.

I claim:

1. In a method of forming a hollow cored concrete slab, precasting of concrete, apart form the slab, an assembly of generally parallel, transversely spaced, connected concrete channel members with depending flanges and upper transverse webs, said precasting including placing rigid metal connecting members transversely of said channel members, embedding said metal connecting members within the webs of the channel members and projecting said metal connecting members outward beyond the outermost of the channel members, casting a base layer of concrete to a given depth within a slab form having recesses; placing the precast channel member assembly on the freshly cast base layer, engaging the projecting portions of the metal connecting members within said recesses in the slab form, positioning the flanges of the channel members in contact with the base layer, casting an upper layer of concrete onto the fresh base layer and around the channel members, striking the upper layer of the concrete in spaced relation above the channel members so that said upper layer of concrete covers the webs of said members to a given depth, and allowing the concrete to cure to complete the slab in which the channel member assembly remains as a structural part and provides for transversely spaced hollow cores therein.

2. The method according to claim 1 wherein the precasting of the concrete channel members includes a casting of these members with longitudinally spaced notches or recesses in the outer surface thereof to effect a mechanical interlock with the adjacent concrete of the slab.

3. In a concrete slab adapted to be formed in a generally rectangular mold having recesses therein, a relatively thin base layer of concrete cast in the bottom portion of the mold, an assembly of transversely spaced, longitudinally extending, precast concrete channel members disposed in the mold on the freshly cast base layer with the flanges of said members in contact with the base layer and the web of said members in spaced relation from the base layer, transversely extending rigid metal connecting rods embedded within the webs of the channel members to secure the members in a given position relative to each other and reinforce the slab to better resist laterally imposed stresses, said rods having the opposed end portions thereof projecting beyond the outermost of the channel members for positioning engagement with said recesses defined in the mold, the flanges of the channel members of the assembly projecting downwardly into the base layer a given distance whereby the channel members are keyed relative to the base layer, and an upper layer of concrete cast upon the base layer and around the spaced channel members of the assembly to fill the mold, said upper layer being struck generally level at a given distance above the channel members to cover the webs thereof to a given depth and which upon curing is bonded integrally to the base layer to form the slab, said channel member assembly being secured as a structural part within the slab to provide a plurality of transversely spaced, generally rectangular hollow cores extending longitudinally of the slab.

4. The construction wherein a plurality of slabs according to claim 3 are arranged side by side to form a floor or deck with the rigid metal connecting rods of a given slab being transversely aligned with the corresponding rods of the other slabs, and rigid metal reinforcement means connecting the corresponding rods of adjacent slabs in the floor or deck to provide for continuous lateral reinforcement across the floor or deck and thereby better distribute any lateral stresses imposed on the floor or deck structure.

* * * * *

UNITED STATES PATENT AND TRADEMARK OFFICE

CERTIFICATE OF CORRECTION

PATENT NO. : 3,949,531

DATED : April 13, 1976

INVENTOR(S) : James L. Fanson

It is certified that error appears in the above-identified patent and that said Letters Patent are hereby corrected as shown below:

Column 1, Line 67, Delete "of" and substitute therefor ---to---;

Column 3, Line 6, Delete "show" and substitute therefor ---shown---;

Column 4, Line 8, Delete "pepes" and substitute therefor ---pipes---;

Column 5, Line 48, Delete "of" second occurrence and substitute therefor ---or---;

Column 5, Line 55, Delete "laterla" and substitute therefor ---lateral---;

Column 5, Line 56, Delete "lateral" and substitute therefor ---other---;

Column 6, Line 35, Delete "form" and substitute therefor ---from---;

Column 7, Line 13, Delete "with" and substitute therefor ---within---.

Signed and Sealed this

Fourteenth Day of September 1976

[SEAL]

*Attest:*

RUTH C. MASON
*Attesting Officer*

C. MARSHALL DANN
*Commissioner of Patents and Trademarks*